US008059849B2

(12) United States Patent
Klein et al.

(10) Patent No.: US 8,059,849 B2
(45) Date of Patent: Nov. 15, 2011

(54) SMALL-FOOTPRINT MICROPHONE MODULE WITH SIGNAL PROCESSING FUNCTIONALITY

(75) Inventors: Hans W. Klein, Danville, CA (US); Bal S. Sandhu, Fremont, CA (US)

(73) Assignee: National Acquisition Sub, Inc., Santa Clara, CA (US)

( * ) Notice: Subject to any disclaimer, the term of this patent is extended or adjusted under 35 U.S.C. 154(b) by 924 days.

(21) Appl. No.: 12/042,673

(22) Filed: Mar. 5, 2008

(65) Prior Publication Data

US 2008/0219483 A1 Sep. 11, 2008

Related U.S. Application Data

(60) Provisional application No. 60/893,106, filed on Mar. 5, 2007, provisional application No. 60/893,107, filed on Mar. 5, 2007.

(51) Int. Cl.
*H04R 25/00* (2006.01)

(52) U.S. Cl. ..... 381/355; 381/111; 381/369; 381/182

(58) Field of Classification Search ..... 381/255–358, 381/365, 369, 170–176, 182, 111
See application file for complete search history.

(56) References Cited

U.S. PATENT DOCUMENTS

| | | | |
|---|---|---|---|
| 5,214,709 | A | 5/1993 | Ribic |
| 7,142,682 | B2 | 11/2006 | Mullenborn et al. |
| 7,206,418 | B2 | 4/2007 | Yang et al. |
| 7,269,268 | B2 | 9/2007 | Song et al. |
| 2004/0161894 | A1 | 8/2004 | Gilton |
| 2006/0120537 | A1 | 6/2006 | Burnett et al. |
| 2006/0177083 | A1 | 8/2006 | Sjursen et al. |

FOREIGN PATENT DOCUMENTS

| | | |
|---|---|---|
| EP | 0942628 | 9/1999 |
| EP | 1091615 | 4/2001 |

OTHER PUBLICATIONS

International Preliminary Report on Patentablity of Jun. 16, 2009 in International Application No. PCT/US2008/055931 12 pages.

International Search Report and Written Opinion of the International Searching Authority in Application PCT/US08/055931, European Patent Office, Jul. 4, 2008, 14 pages.

*Primary Examiner* — Suhan Ni

(74) *Attorney, Agent, or Firm* — Rader, Fishman & Grauer, PLLC

(57) ABSTRACT

An acoustic processing module receives an acoustic signal, and outputs an analog output signal. Microphone sensors are provided for generating a corresponding electrical signal in response to the acoustic signal. A signal processing circuit is connected to the microphone sensors, and processes the electrical signals according to one or more analog signal processing functions to generate the analog output signal. An integrated casing encapsulates the microphone sensors and the analog processing circuit, and prevents external interference from affecting any electrical signals within the integrated casing.

19 Claims, 5 Drawing Sheets

SMALL-FOOTPRINT MICROPHONE MODULE WITH SIGNAL PROCESSING FUNCTIONALITY

CROSS-REFERENCE TO RELATED APPLICATION

This application claims the benefit under 35 USC 119(e) of and commonly owned U.S. Provisional Application No. 60/893,106 entitled "Small-Footprint Microphone Module with Signal Processing Functionality" filed on Mar. 5, 2007, and U.S. Provisional Application No. 60/893,107 entitled "Low-impedance Output Amplifier with Programmable Gain and DC Output Level" also filed on Mar. 5, 2007, all of which are herein incorporated by reference in their entirety.

FIELD OF THE INVENTION

The present invention relates generally to audio signal processing and more particularly to an integrated module containing microphone capsules and related signal processing circuitry.

BACKGROUND

A variety of sensors exist for converting real-world properties into electrical signals that can be manipulated for various purposes. For example, an electret condenser microphone (ECM) converts acoustic signals (e.g., such as a person's voice) into analog electrical signals that can be provided to an associated device such as a personal computer, cellular phone, wireless phone, conference phone, voice recorder, and so on. Many such associated devices include a well-known analog input interface to receive the electrical signals that embody the acoustic signal as captured by one or more ECMs.

For example, FIG. 5 shows a conventional ECM 50 connected to an associated device 500 via a signal line 10. ECM 50 includes an ECM capsule 51 and a junction field-effect transistor (JFET) 52. The output of ECM capsule 51 is connected to the gate of JFET 52, which is coupled between a voltage supply (VDD) and ground potential. ECM capsule 51 converts acoustic signals (e.g., such as a person's voice) into electrical signals, and JFET 52 amplifies the electrical signals received from ECM capsule 51 to produce a low-impedance analog output signal. Although JFET 52 consumes valuable circuit area and requires a connection to VDD, its amplifying function reduces the output signal's susceptibility to undesirable external interference such as electric fields and magnetic fields. Thus, without JFET 52, the high-impedance signal output from ECM capsule 51 is very susceptible to such interference.

The analog output signal (OUT) is provided from ECM 50 via signal line 10 and is received into device 500 via a well-known input interface 520 that includes a bias resistor (Rbias) connected between VDD and signal line 10. A coupling capacitor (Cin) blocks unwanted DC components of the analog input signal from being transmitted to circuitry 510 within device 500. VDD is a standard operating voltage (e.g., such as 1.8 volts or 3.3 volts), and Rbias is sized to bias the input signal line 10 at approximately 1.5 volts. Typically, the input signal line 10 is responsive to voltage differentials of a few tens to a few hundred milli-volts in the analog output signal OUT, and can provide between 200-300 uA of current to ECM 50. Because input interface 520 is configured to receive analog signals from ECM 50, input interface 520 is sometimes referred to as an ECM-compatible interface. Indeed, to ensure compatibility of device 500 with external microphones such as ECM 50, input interface 520 is typically configured to operate as described above.

In many applications, it is desired to improve the sound quality of acoustic signals provided by microphones such as ECM 50. For example, a digital signal processing (DSP) based circuit can be connected between the ECM and the associated device and configured to processes the electrical signals provided by the ECM using various techniques such as noise reduction and directional sensitivity to improve sound quality. The DSP based solution typically includes an analog-to-digital converter (ADC), a DSP circuit, and possibly a digital-to-analog converter (DAC). The ADC converts the analog signals received from the ECM into digital signals that can be processed by the DSP circuit to perform one or more desired functions such as noise reduction and/or directional sensitivity. The DAC converts the digital signals output from the DSP circuit back into analog electrical signals that are compatible for input to ECM input interface 520 of device 500.

The various components of the DSP engine (e.g., the DSP circuit, the ADC and DAC circuits, and other associated circuitry) are relatively complex, require a significant amount of silicon area, and consume significantly more power than is typically available from the signal line 10 connected to an ECM-compatible analog input such as input interface 520. As a result, the DSP engine is typically formed as a separate IC chip that includes its own power connections to VDD and includes input terminals to receive electrical signals embodying acoustic signals from a separate microphone circuit, which undesirably limits the ability for such systems to be miniaturized and/or deployed in low-power applications. Accordingly, there is a need for a microphone system that can implement signal processing functions such as noise reduction and directional sensitivity and yet be housed in module that is significantly smaller and requires significantly less power than conventional acoustic processing systems.

BRIEF DESCRIPTION OF THE DRAWINGS

Like reference numerals refer to corresponding parts throughout the drawing figures.

DETAILED DESCRIPTION

Figure 1A:
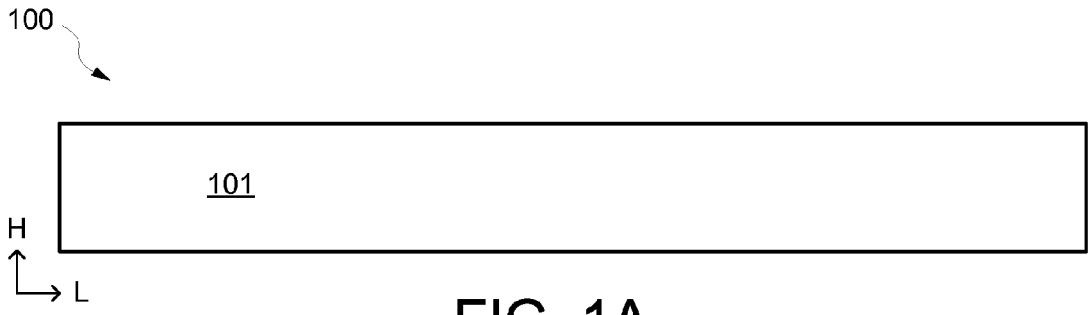
FIG. 1A shows a side plan view of an integrated acoustic processing module in accordance with some embodiments of the present invention.

Embodiments of the present invention are described below in the context of an acoustic processing module having two ECM capsules for simplicity only. It is to be understood that acoustic processing modules in accordance with embodiments of the present invention can include any suitable number of ECM capsules. For other embodiments, other types of microphone sensors (e.g., such as those fabricated in silicon using Micro Electro-Mechanical Systems (MEMS) technology) can be used. Alternately, embodiments of the present invention can include sensors other than microphone sensors such as, for example, accelerometers. In the following description, for purposes of explanation, specific nomenclature is set forth to provide a thorough understanding of the present invention. In other instances, well-known circuits and devices are shown in block diagram form to avoid obscuring the present invention unnecessarily. For example, the interconnection between circuit elements or circuit blocks may be shown or described as multi-conductor or single conductor signal lines. Each of the multi-conductor signal lines may alternatively be single-conductor signal lines, and each of the single-conductor signal lines may alternatively be multi-conductor signal lines. Signals and signaling paths shown or described as being single-ended may also be differential, and signals and signaling paths shown or described as being differential may also be single-ended. Further, the logic states of various signals described herein are exemplary and therefore may be reversed or otherwise modified as generally known in the art. Accordingly, the present invention is not to be construed as limited to specific examples described herein but rather includes within its scope all embodiments defined by the appended claims.

In accordance with embodiments of the present invention, an integrated acoustic processing module is disclosed that includes a number of ECM capsules directly connected to a signal processing circuit capable of improving the sound quality of acoustic signals captured by the ECM capsules using techniques such as noise reduction and/or directional sensitivity. For some embodiments, the acoustic processing module also includes a non-volatile memory to store configuration information and/or various acoustic profiles for the signal processing circuit. All of the components of the acoustic processing module are encapsulated together in a casing that electrically isolates the acoustic processing module from external interference such as electric fields, magnetic fields, RF waves, and so on. In this manner, the module's ECM capsules can be connected directly to the signal processing circuitry, for example, without the use of JFET drivers, thereby reducing the size and power consumption of the module.

For some embodiments, the module's signal processing circuit processes signals received from the ECM capsules entirely in the analog domain, and employs analog processing circuits that consume significantly less power than DSP engines and/or microprocessors that execute signal processing software. For example, the primary driver of power consumption in a digital circuit is switching between 0 (logic low) and 1 (logic high), which requires charging and discharging nodal capacitances from ground to the power supply voltage in a short period of time. In contrast, an analog implementation does not require such drastic signal swings in such a short period of time. Further, because a single signal is represented digitally using several bits, several nodes must be simultaneously charged and discharged for each operation. In contrast, an analog signal can be represented by a voltage on a single node. In addition, by employing a signal processing circuit that operates in the analog domain, ADC and DAC converters are not required in embodiments of the present invention, thereby further reducing circuit size and power consumption.

Figure 1B:
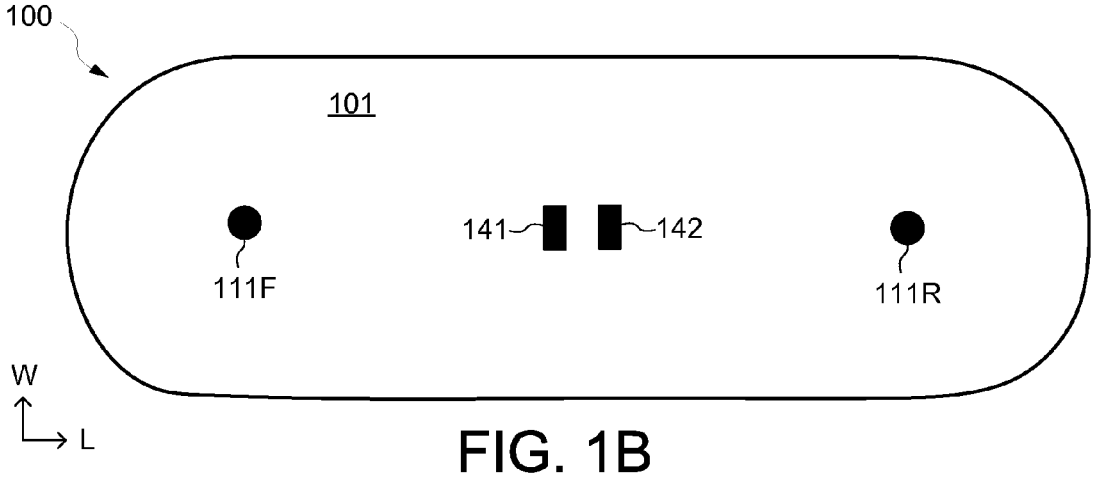
FIG. 1B shows a top plan view of the integrated acoustic processing module of FIG. 1A.
Figure 1C:
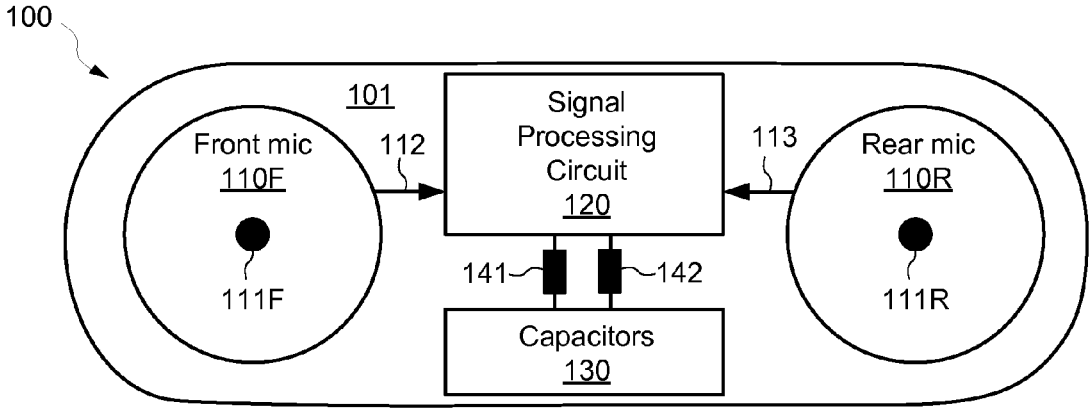
FIG. 1C shows a cross-sectional block diagram of the integrated acoustic processing module of FIG. 1A.
Figure 5:
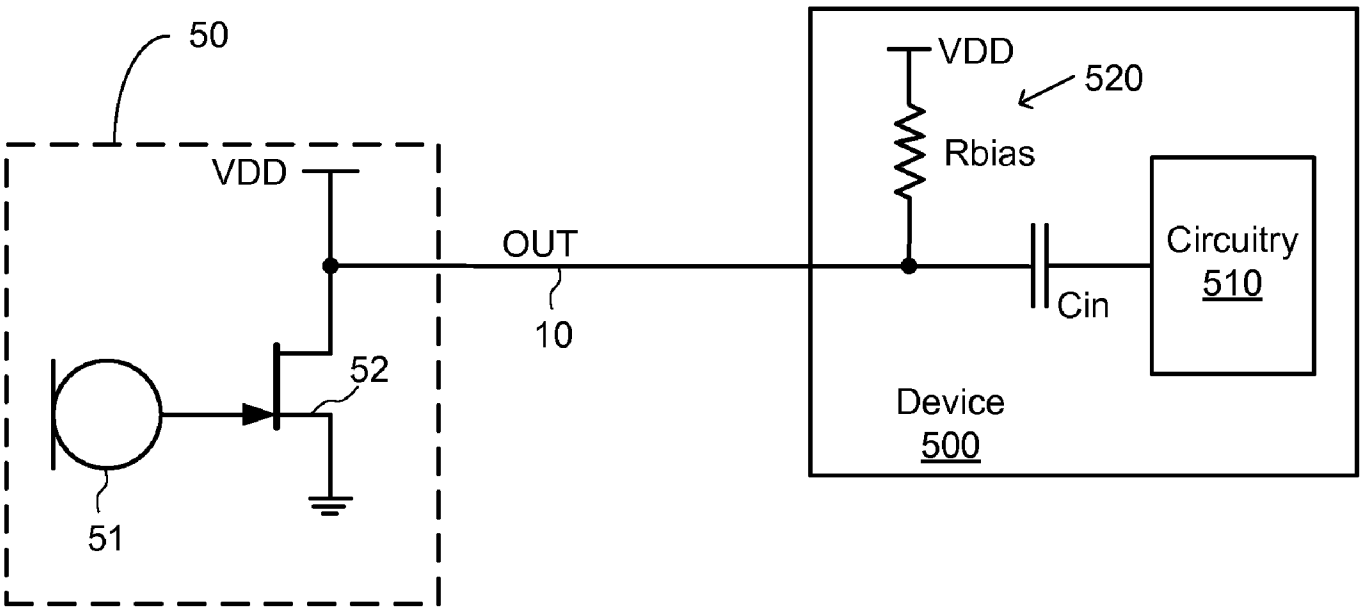
FIG. 5 (prior art)
FIG. 5 shows a simplified block diagram of a conventional ECM connected to an associated device.

An acoustic processing module 100 in accordance with some embodiments of the present invention is shown in FIGS. 1A-1C as including a front microphone sensor 110F, a rear microphone sensor 110R, input ports 111F and 111R, a signal processing circuit 120, capacitors 130, and pins 141-142. For exemplary embodiments described herein, microphone sensors 110 are well-known ECM capsules (e.g., such as ECM capsules 51 of FIG. 5) that do not include JFET drivers, although other types of sensors can be used. In accordance with the present invention, all of the components of the acoustic processing module 100 are completely encapsulated together by an integrated casing 101 that prevents external electrical fields, RF signals, and other interference from affecting operations of the modules' internal components. More specifically, the encapsulating casing 101 acts as a Faraday cage to maintain a constant and uniform electrical field inside the casing 101 so that external interference does not affect the electrical signals generated by and/or processed within the module 100. Casing 101 can be formed of any suitable material (e.g., such as metal). For one exemplary embodiment, the components of module 100 can be surface mounted on a printed circuit board (PCB) and then encapsulated using a metal lid to form casing 101.

Input ports 111F and 111R, which are well-known, are formed within the casing 101 and provide acoustic signals (e.g., such as sound waves from a speaker's voice) to front ECM capsule 110F and rear ECM capsule 110R, respectively. In response thereto, front ECM capsule 110F and rear ECM capsule 110R provide electrical signals embodying the acoustic signals directly to inputs of signal processing circuit 120 via signal lines 112 and 113, respectively.

In one embodiment, the acoustic processing can be used to form an acoustic beam, referred to as a "beamformer" function. An acoustic beam is equivalent to having enhanced microphone sensitivity in one or more preferred directions, and a reduced sensitivity in one or more other directions. Such beam can be formed using 2 or more microphones and appropriate signal processing. Such beam can also be constructed as being fixed or variable. In the latter case, the acoustic beam (direction of sensitivity) can be processed to change in response to acoustic signals, such as undesired interference. When an acoustic beam is "steered" into a certain direction dynamically, the function is referred to as "beam steering". In embodiments disclosed herein, the signal processing contained in the integrated module can perform both beam forming as well as beam steering operations, depending on the needs of the application. It should be noted that beam forming is a subset of beam steering (specifically, in the case of a fixed beam), thus, for purposes of discussion, the terms "beam forming" and "beam steering" are herein used interchangeably.

Signal processing circuit 120 receives the analog electrical signals directly from microphone sensors 110F and 110R, and in response thereto processes the signals using analog circuitry to improve the sound quality of the acoustic signals using any number of techniques. For some embodiments, signal processing circuit 120 can include well-known analog noise reduction circuitry (not shown for simplicity) that reduces undesired noise, for example, using an array of filters. For other embodiments, signal processing circuit 120 can include an analog beamformer circuit (not shown for simplicity) that provides directional sensitivity by reducing undesired acoustic interference using an array of filters and other processing circuitry (not shown for simplicity). For still other embodiments, signal processing circuit 120 can include both noise reduction circuitry and a beamformer circuit. Capacitors 130, which are well-known, are connected to the output terminal and form a high pass filter that passes desired acoustic components of the output signal while filtering unwanted RF components from the output signal.

Pins 141-142 are formed in casing 101 using well-known techniques. For some embodiments, pin 141 operates as both an output pin for providing analog output signals generated by signal processing circuit 120 to an associated device (not shown in FIGS. 1A-1C for simplicity) and as a power pin that provides power to module 100, and pin 142 provides a ground connection for module 100. For such embodiments, pin 141 can be connected to a standard (e.g., ECM-compatible) analog input interface of the associated device so that module 100 provides ECM-compatible analog electrical signals to the associated device while receiving power from the input interface via the same pin. More specifically, for some embodiments, ECM capsules 111 and processing circuit 120 can operate using approximately 200-300 uA of current at 1.5 volts, and therefore can be powered entirely from the bias voltage and current typically provided by ECM-compatible input interfaces such input interface 520 of FIG. 5. In this manner, acoustic processing module 100 can easily be substituted for standard ECM sensors in a plug-and-play manner (e.g., without any system modifications). For example, module 100 can be connected directly to input interface 520 of device 500, thereby allowing the conventional ECM sensor 50 to be easily replaced with module 100, which can perform acoustic signal processing functions not performed by conventional ECM sensor 50.

As described above, employing analog signal processing circuits rather than DSP engines not only reduces power consumption but also can reduce circuit size. Further, connecting the ECM capsules directly to the analog signal processing circuit and housing them together in an integrated electrically shielded casing allows for the elimination of JFET drivers typically required for ECM sensors, thereby further reducing power consumption and circuit size. As a result, acoustic processing modules in accordance with present embodiments are relatively small compared to conventional microphone systems that perform signal processing to improve sound quality. For example, in one embodiment of module 100, ECM capsules 111F and 111R are spaced approximately 5-15 mm apart, and casing 101 is approximately 1.5 mm high (H) by 5 mm wide (W) by 15 mm long (L), with the directional legends H, W, and L indicated in FIGS. 1A-1B.

Further, as known in the art, JFET drivers (e.g., such as JFETs 52 of FIG. 5) have temperature coefficients that cause the JFETs to behave differently at different temperatures. Thus, by eliminating JFET drivers from module 100, the output signal of module 100 is less susceptible to temperature variations, thereby improving performance over conventional ECM sensors that include JFET drivers.

For other embodiments, module 100 can include separate power and output pins, and/or can include other pins to output or receive other signals and information. For example, for one embodiment, module 100 can include a configuration pin (not shown for simplicity) to receive configuration information, as described in more detail below with respect to FIG. 3.

Figure 2:
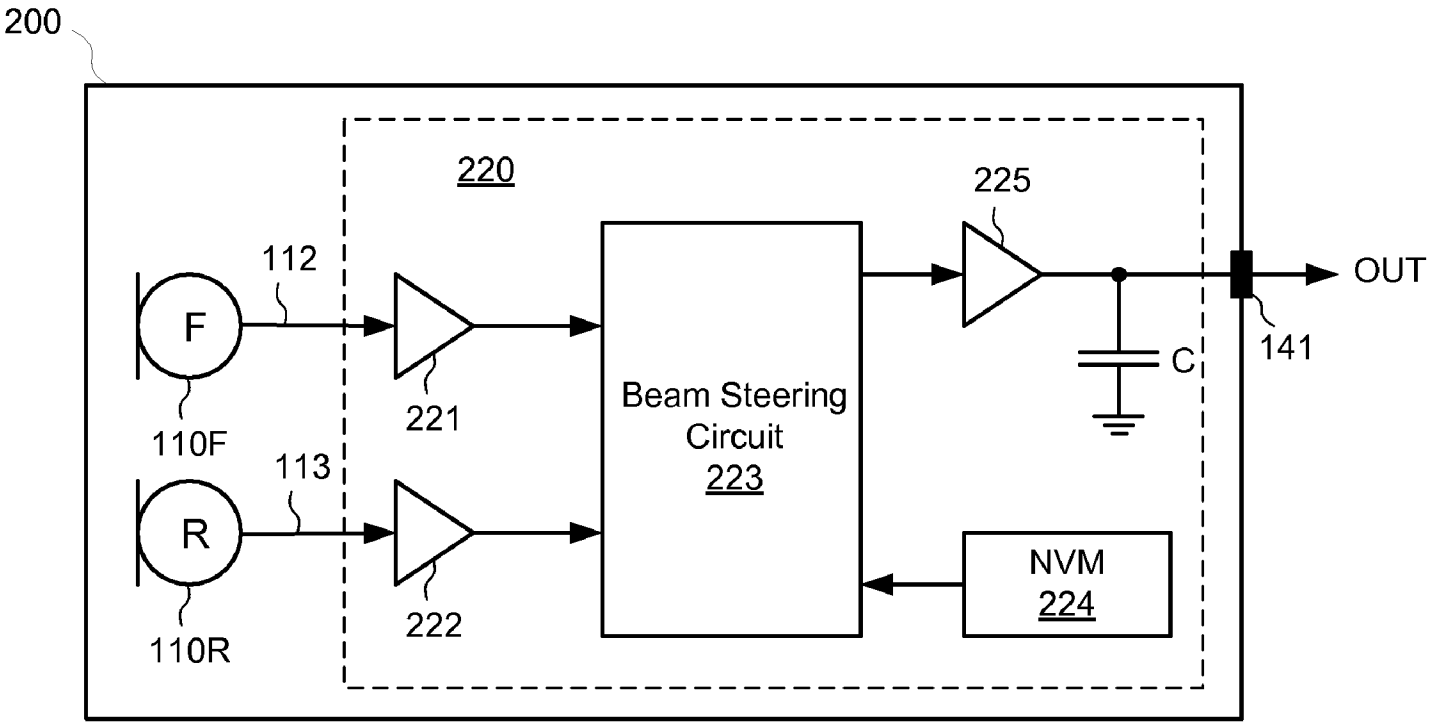
FIG. 2 shows a simplified block diagram of the integrated acoustic processing module of FIGS. 1A-1C showing a beam steering circuit that is one embodiment of the signal processing circuit of FIG. 1C.

FIG. 2 shows a simplified block diagram of an acoustic processing module 200 configured in accordance with some embodiments to perform beam steering (and beam forming) functions. Acoustic processing module 200 is shown in FIG. 2 as including front ECM capsule 110F, rear ECM capsule 110R, and a signal processing circuit 220. Signal processing circuit 220, which is one embodiment of signal processing circuit 120 of FIG. 1C, includes input buffers 221-222, a beam steering engine 223, a non-volatile memory (NVM) 224, an output buffer 225, and an output capacitor C. For other embodiments, module 200 can include any suitable number of microphone sensors. Further, although not shown in FIG. 2 for simplicity, all of the components of module 200 are completely encapsulated together by the integrated casing 101 that shields the module's components from external interference such as electrical fields, magnetic fields, RF signals, and so on.

Input buffers 221-222 are well-known, and provide the analog electrical signals generated by ECM capsules 110F and 110R, respectively, directly to beam steering circuit 223, and act as low-noise buffers. Beam steering circuit 223 includes a plurality of separate filtering circuits (not shown for simplicity), each of which is selectable to provide a null in a corresponding location relative to a longitudinal axis (L) of the module that cancels unwanted noise originating from the corresponding location. For some embodiments, beam steering circuit 223 is of the type disclosed in co-pending and commonly owned U.S. patent application Ser. No. 11/737,127 entitled "Response Select Null Steering Circuit" and filed Apr. 18, 2007, the entirety of which is incorporated herein by reference. For other embodiments, other beam steering circuits can be used.

NVM 224 is coupled to beam steering circuit 223, and stores configuration information for beam steering circuit 223. NVM 224 can be any suitable type of non-volatile memory including, for example, PROM cells, EPROM cells, EEPROM cells, flash memory cells, fuses, hardwired signals, and so on. For some embodiments, the configuration data can be stored in NVM 224 in digital form. For other embodiments, some or all of the configuration data can be stored in NVM 224 in analog form. For example, rather than programming the memory cells of NVM 224 to traditional binary values (e.g., either to a programmed state or an erased state), the memory cells can be incrementally programmed so that their relative threshold voltages are indicative of a desired parameter value.

For some embodiments, the configuration information stored in NVM 224 includes calibration information for ECM capsules 110F and 110R and other beam steering (or beam forming) parameters. For example, due to fabrication variations inherent in the manufacture of ECM capsules, it is very difficult to produce a pair of ECM capsules that are precisely matched. In addition, when the ECM capsules are positioned within modules of the present invention, the lateral spacing between the capsules must be known to correctly perform noise reduction and directional sensitivity functions. Thus, after the ECM capsules 110 are pre-tuned and inserted into the module, they are tested to determine any mismatches, and the corresponding calibration information is stored in NVM 224. The beam steering parameters can include null direction indicators, detection thresholds for null steering decisions, switching speeds, and so on. Thereafter, during operation of the module, NVM 224 provides the configuration information to beam steering circuit 223, which in response thereto adjusts its filter coefficients, reference voltages, and other signals therein to compensate for ECM capsule mismatches and the lateral spacing between the capsules, and to implement other desired beam steering (or beam forming) characteristics in beam steering circuit 223.

Further, for some embodiments, NVM 224 can be configured to store one or more acoustic profiles that can be selected by the manufacturer, the customer, or by some other means. Each acoustic profile can include a plurality of filter coefficients each determining the relative location of the null provided by a corresponding one of the beam steering circuit's filters, the criteria used to switch between filters as the location of the desired target source changes, output configurations, and so on. The acoustic profiles can be specifically tailored to predetermined applications or environments, to characteristics requested by a customer, and so on. For example, a first acoustic profile may be tailored to provide omni-directional sensitivity, a second acoustic profile may be tailored to provide directional sensitivity only along a specified line relative to the longitudinal axis (L) of the microphone sensors, a third acoustic profile may be tailored to move the directional sensitivity of acoustic reception in response to aggregated movements of a desired speaker, and so on. For such embodiments, during operation of the module, NVM 224 provides the selected acoustic profile as configuration information to beam steering circuit 223, which in response thereto adjusts its filter coefficients, reference voltages, and other signals therein.

Figure 3:
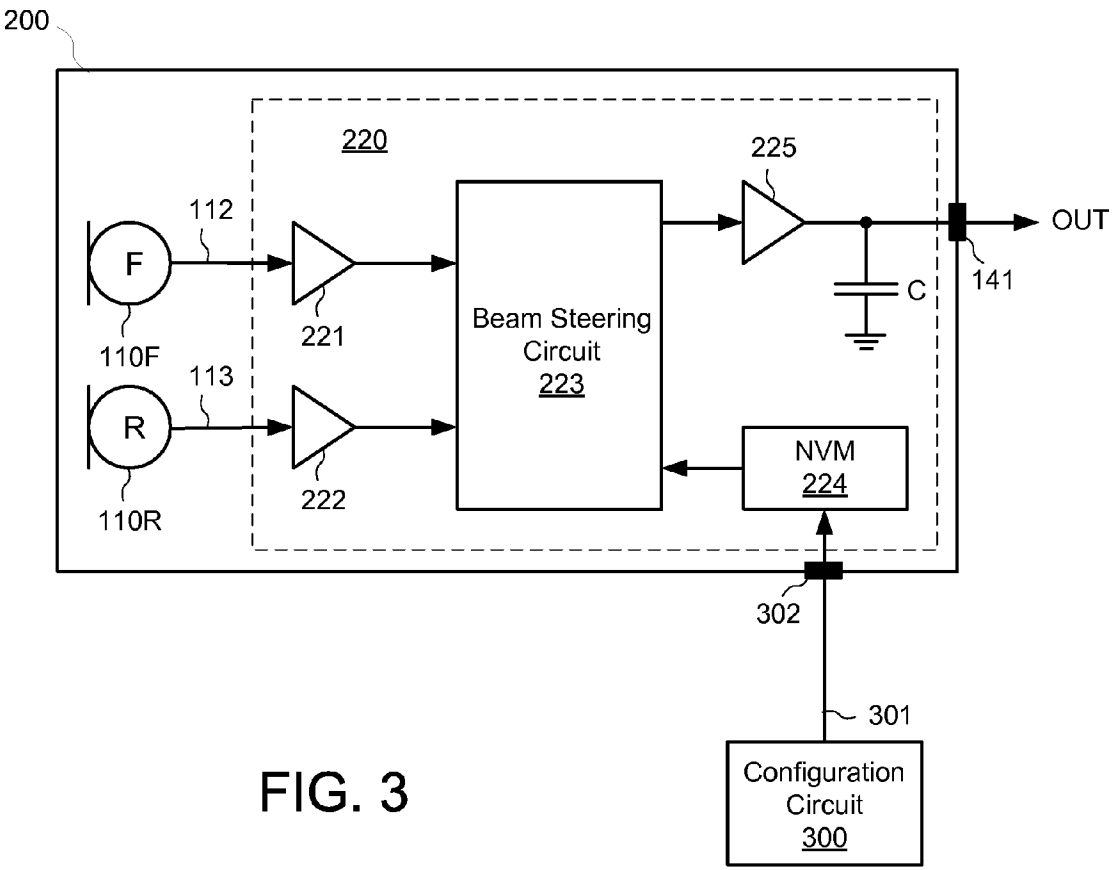
FIG. 3 shows a simplified block diagram of the integrated acoustic processing module of FIG. 2.

Further, for other embodiments, module 200 can include a configuration interface 302 that allows configuration information such as calibration information and acoustic profiles to be programmed to NVM 224 from an external configuration device 300 via communications link 301, as depicted in FIG. 3. For some embodiments, configuration interface 302 can receive configuration information from an input device (e.g., such as a computer) via a digital serial interface. In yet other embodiments, configuration circuitry (e.g., the configuration device 300) may be integrated within the module 200, thus enabling the module 200 to be self-configurable (e.g., by placing the module 200 in a "tuning" or "learning" mode).

Figure 4:
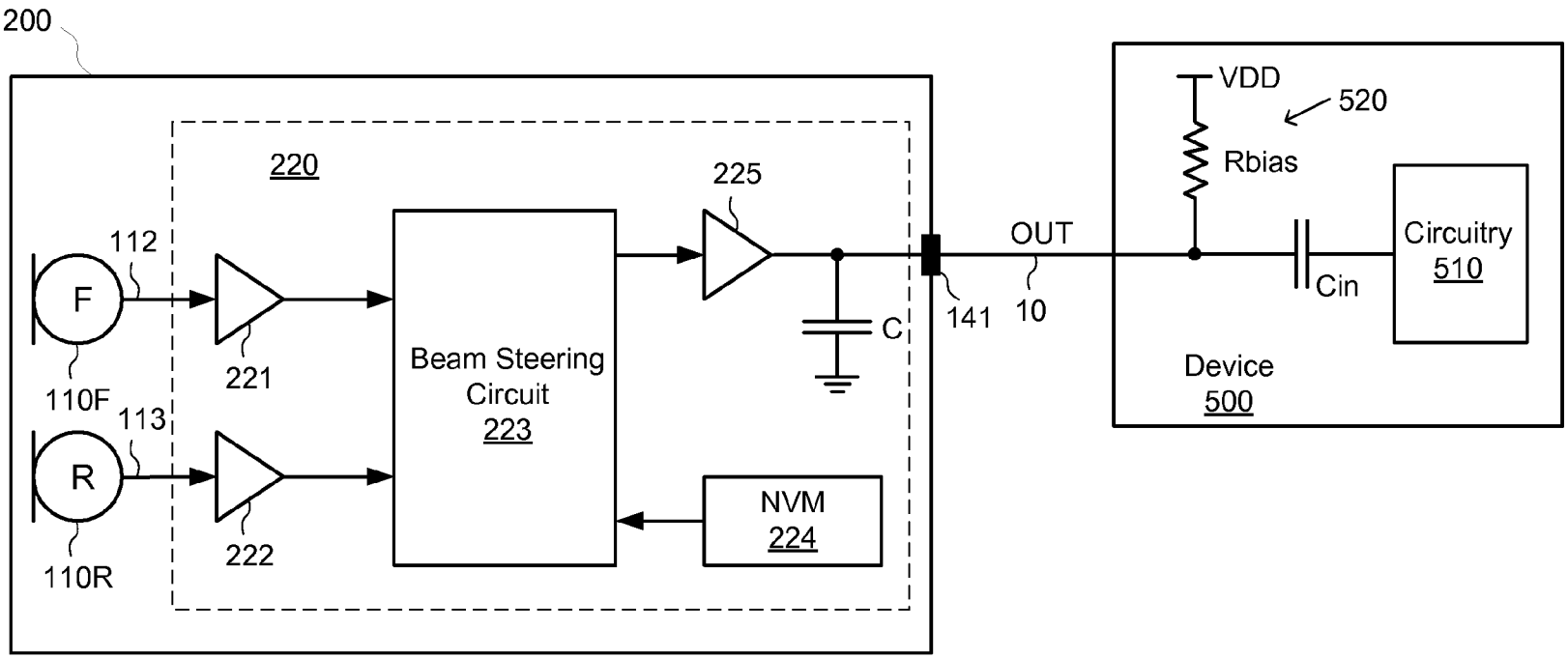
FIG. 4 shows a simplified block diagram of the integrated acoustic processing module of FIG. 2 connected to an associated device via an ECM-compatible input interface.

As described above, beam steering circuit 223 can operate solely in the analog domain, and provides an ECM-compatible analog output signal to output pin 141, which as described above can be connected to an analog input interface of an associated device. For example, FIG. 4 shows acoustic processing module 200 having its output pin 141 connected to associated device 500 via signal line 10. More specifically, module 200 provides an analog (ECM-compatible) output signal (OUT) to device 500 via its input interface 520, which as described above includes a bias resistor (Rbias) that biases signal line 10 at approximately 1.5 volts and provides an ECM-standard bias current of approximately 200-300 uA to signal line 10. The bias current and voltage provided by input interface 520 of device 500 are sufficient to power all components of module 200, thereby eliminating the need for module 200 to include its own power supply or to include a dedicated power connection to VDD. In this manner, module 200 can be easily inserted as the microphone sensor into any ECM-compatible systems, and is ideal for portable and low power applications in which external voltage supplies are unavailable and/or otherwise not desirable.

Although the invention has been described with reference to specific exemplary embodiments thereof, it will be evident that various modifications and changes may be made thereto without departing from the broader spirit and scope of the invention as set forth in the appended claims. The specification and drawings are, accordingly, to be regarded in an illustrative rather than a restrictive sense. For example, modules of the present invention can include types of sensors other than acoustic sensors. One such example is a glass-break detector module, where the sensors could be a combination of acoustic and shock sensors, and the processing could involve shock detection, timing evaluation, and acoustic pattern matching, to mention a few. All this would be desirably housed in a tiny module providing robust glass-break detection signals in a "plug-and-play" manner to the outside world, by simply delivering a simple on/off signal compatible with traditional passive sensors.

What is claimed is:

1. An acoustic processing module having an input to receive an acoustic signal and having an output terminal to provide an analog output signal, comprising:

a number of microphone sensors, each for generating a corresponding audio electrical signal in response to the acoustic signal;

a signal processing circuit having inputs connected directly to the microphone sensors and configured to process the audio electrical signals according to one or more analog signal processing functions to generate the analog output signal at the output terminal of the module; and an integrated casing encapsulating the microphone sensors and the signal processing circuit together and configured to prevent external interference from affecting the audio electrical signals or any other electrical signals within the integrated casing, wherein the output terminal is configured to provide the analog output signal to an ECM-compatible input interface of an associated device, and to receive power from the ECM-compatible input interface.

2. The module of claim 1, wherein the module operates only in an analog domain.

3. The module of claim 1, wherein the signal processing circuit comprises a beam steering circuit.

4. The module of claim 3, wherein the beam steering circuit comprises circuitry for performing a beam forming operation.

5. The module of claim 3, wherein the beam steering circuit comprises circuitry for performing a beam steering operation.

6. The module of claim 1, wherein the signal processing circuit comprises a noise reduction circuit.

7. The module of claim 1, wherein each microphone sensor consists of an electret condenser microphone (ECM) capsule.

8. The module of claim 1, wherein the module is powered entirely by the ECM-compatible input interface.

9. The module of claim 1, wherein the signal processing circuit further comprises:

a non-volatile memory for storing configuration information including calibration data for the microphone sensors.

10. The module of claim 9, wherein the signal processing circuit further comprises:

a configuration interface for receiving the configuration data from a user.

11. The module of claim 1, wherein the module does not include a digital signal processing (DSP) engine.

12. The module of claim 1, wherein the acoustic module does not include an analog-to-digital converter.

13. An acoustic processing module, comprising:

a number of electret condenser microphone (ECM) capsules, each for generating a corresponding analog audio signal in response to a received acoustic signal;

a signal processing circuit having inputs connected directly to the ECM capsules and having an output to generate an ECM-compatible analog output signal, wherein the signal processing circuit includes an analog beam steering circuit that filters the analog audio signals provided by the ECM capsules using analog processing techniques to generate the ECM-compatible analog output signal;

an integrated casing encapsulating the ECM capsules and the signal processing circuit together and configured to prevent external interference from affecting the audio analog signals or any other electrical signals within the integrated casing; and an output pin for providing the ECM-compatible analog output signal to an associated device and for receiving power from the associated device.

14. The module of claim 13, wherein the output pin is connected to an ECM-compatible input interface of the associated device via a signal line.

15. The module of claim 14, wherein the signal line provides less than 300 uA of current to the module.

16. The module of claim 14, wherein the module is powered entirely by the ECM-compatible input interface.

17. The module of claim 13, wherein the signal processing circuit further comprises:

a non-volatile memory for storing configuration information containing calibration data for the ECM capsules and one or more acoustic profiles for the beam steering circuit.

18. The module of claim 17, wherein the signal processing circuit further comprises:

a configuration interface for receiving the configuration data from a user.

19. The module of claim 17, wherein each acoustic profile includes a different set of filter coefficients for the beam steering circuit.

* * * * *